US006000933A

United States Patent [19]

Frederick, Sr.

[11] Patent Number: 6,000,933

[45] Date of Patent: Dec. 14, 1999

[54] VARIABLE BURNER ORIFICE FURNACE MANIFOLD

[76] Inventor: Charles B Frederick, Sr., P.O. Box 72, Wagner, S. Dak. 57380

[21] Appl. No.: 08/835,059

[22] Filed: Apr. 4, 1997

[51] Int. Cl.[6] ..... F23Q 9/00

[52] U.S. Cl. ..... 431/278; 126/110 R; 126/116 R; 137/561 R; 137/556.6

[58] Field of Search ..... 126/110 R, 116 R, 126/39 N, 39 R; 431/278, 12, 350; 137/883, 561 R, 556.6; 251/147

[56] References Cited

U.S. PATENT DOCUMENTS

| | | | |
|---|---|---|---|
| D. 304,070 | 10/1989 | Hughes | D23/245 |
| D. 352,094 | 11/1994 | Baker | D23/244 |
| 966,878 | 8/1910 | Akerstream et al. | 126/116 R |
| 3,241,544 | 3/1966 | Lohman | 126/116 R |
| 3,744,752 | 7/1973 | Massey | 137/566.6 |
| 4,174,948 | 11/1979 | Bradley et al. | 432/54 |
| 4,191,215 | 3/1980 | Gonner | 137/870 |
| 4,302,178 | 11/1981 | Belknap et al. | 431/19 |
| 4,392,509 | 7/1983 | Siddell | 137/340 |
| 4,570,908 | 2/1986 | King | 266/236 |
| 4,585,021 | 4/1986 | Belknap | 137/100 |
| 4,869,284 | 9/1989 | Scott et al. | 137/100 |
| 5,094,224 | 3/1992 | Diesch | 126/110 R |
| 5,234,196 | 8/1993 | Harris | 251/328 |

*Primary Examiner*—James C. Yeung

[57] ABSTRACT

A new variable burner orifice furnace manifold for reducing the amount of heating fuel used without reducing the heating ability of the furnace. The inventive device includes a manifold pipe with a plurality of spaced apart gas exit openings between its open supply end and its closed end. The gas exit openings are inserted into the burner assembly of a furnace and the supply end is attached to an external heating fuel supply. A valve permitting selective opening and closing is included on the manifold pipe. The valve is positioned on the manifold pipe so that no more than half the total number of gas exit openings are positioned between the valve and the manifold pipe closed end. When the valve is closed, gas flow through the gas exit openings between the valve and the closed end is shut off while gas flow through the gas exit openings between the valve and the open supply end is unaffected.

1 Claim, 3 Drawing Sheets

VARIABLE BURNER ORIFICE FURNACE MANIFOLD

BACKGROUND OF THE INVENTION

1. Field of the Invention

The present invention relates to manifold systems and more particularly pertains to a new variable burner orifice furnace manifold for reducing the amount of heating fuel used without reducing the heating ability of the furnace.

2. Description of the Prior Art

The use of manifold systems is known in the prior art. More specifically, manifold systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art manifold systems include U.S. Pat. No. 4,570,908; U.S. Pat. No. 5,234,196; U.S. Pat. No. 4,174,948; U.S. Pat. No. 4,585,021; U.S. Pat. No. 4,302,178; U.S. Pat. No. 4,392,509; U.S. Pat. No. 4,869,284; U.S. Pat. No. 4,191,215; U.S. Pat. No. Des. 304,070; and U.S. Pat. No. Des. 352,094.

While these devices fulfill their respective, particular objectives and requirements, the aforementioned patents do not disclose a new variable burner orifice furnace manifold. The inventive device includes a manifold pipe with a plurality of spaced apart gas exit openings between its open supply end and its closed end. The gas exit openings are inserted into the burner assembly of a furnace and the supply end is attached to an external heating fuel supply. A valve permitting selective opening and closing is included on the manifold pipe. The valve is positioned on the manifold pipe so that no more than half the total number of gas exit openings are positioned between the valve and the manifold pipe closed end. When the valve is closed, gas flow through the gas exit openings between the valve and the closed end is shut off while gas flow through the gas exit openings between the valve and the open supply end is unaffected.

In these respects, the variable burner orifice furnace manifold according to the present invention substantially departs from the conventional concepts and designs of the prior art, and in so doing provides an apparatus primarily developed for the purpose of reducing the amount of heating fuel used without reducing the heating ability of the furnace.

SUMMARY OF THE INVENTION

In view of the foregoing disadvantages inherent in the known types of manifold systems now present in the prior art, the present invention provides a new variable burner orifice furnace manifold construction wherein the same can be utilized for reducing the amount of heating fuel used without reducing the heating ability of the furnace.

The general purpose of the present invention, which will be described subsequently in greater detail, is to provide a new variable burner orifice furnace manifold apparatus and method which has many of the advantages of the manifold systems mentioned heretofore and many novel features that result in a new variable burner orifice furnace manifold which is not anticipated, rendered obvious, suggested, or even implied by any of the prior art manifold systems, either alone or in any combination thereof.

To attain this, the present invention generally comprises a manifold pipe with a plurality of spaced apart gas exit openings between its open supply end and its closed end.

The gas exit openings are inserted into the burner assembly of a furnace and the supply end is attached to an external heating fuel supply. A valve permitting selective opening and closing is included on the manifold pipe. The valve is positioned on the manifold pipe so that no more than half the total number of gas exit openings are positioned between the valve and the manifold pipe closed end. When the valve is closed, gas flow through the gas exit openings between the valve and the closed end is shut off while gas flow through the gas exit openings between the valve and the open supply end is unaffected.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new variable burner orifice furnace manifold apparatus and method which has many of the advantages of the manifold systems mentioned heretofore and many novel features that result in a new variable burner orifice furnace manifold which is not anticipated, rendered obvious, suggested, or even implied by any of the prior art manifold systems, either alone or in any combination thereof.

It is another object of the present invention to provide a new variable burner orifice furnace manifold which may be easily and efficiently manufactured and marketed.

It is a further object of the present invention to provide a new variable burner orifice furnace manifold which is of a durable and reliable construction.

An even further object of the present invention is to provide a new variable burner orifice furnace manifold which is susceptible of a low cost of manufacture with regard to both materials and labor, and which accordingly is then susceptible of low prices of sale to the consuming public, thereby making such variable burner orifice furnace manifold economically available to the buying public.

Still yet another object of the present invention is to provide a new variable burner orifice furnace manifold which provides in the apparatuses and methods of the prior art some of the advantages thereof, while simultaneously overcoming some of the disadvantages normally associated therewith.

Still another object of the present invention is to provide a new variable burner orifice furnace manifold for reducing the amount of heating fuel used without reducing the heating ability of the furnace.

Yet another object of the present invention is to provide a new variable burner orifice furnace manifold which includes a manifold pipe with a plurality of spaced apart gas exit openings between its open supply end and its closed end. The gas exit openings are inserted into the burner assembly of a furnace and the supply end is attached to an external heating fuel supply. A valve permitting selective opening and closing is included on the manifold pipe. The valve is positioned on the manifold pipe so that no more than half the total number of gas exit openings are positioned between the valve and the manifold pipe closed end. When the valve is closed, gas flow through the gas exit openings between the valve and the closed end is shut off while gas flow through the gas exit openings between the valve and the open supply end is unaffected.

Still yet another object of the present invention is to provide a new variable burner orifice furnace manifold that restricts the flow of gas into the heat exchanger of a furnace.

Even still another object of the present invention is to provide a new variable burner orifice furnace manifold that reduces the number of orifices used in a furnace.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
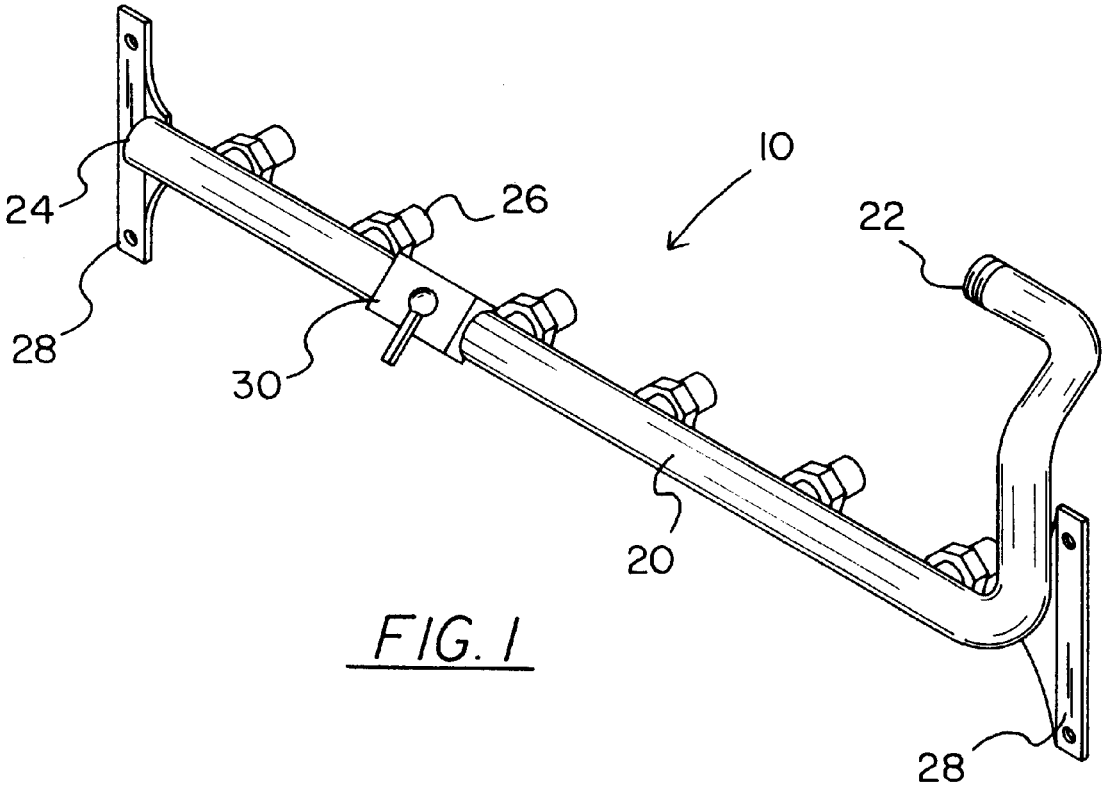
FIG. 1 is a perspective view of a new variable burner orifice furnace manifold with six gas exit orifices according to the present invention.

With reference now to the drawings, and in particular to FIGS. 1 through 5 thereof, a new variable burner orifice furnace manifold embodying the principles and concepts of the present invention and generally designated by the reference numeral 10 will be described.

As best illustrated in FIGS. 1 through 5, the variable burner orifice furnace manifold 10 includes a manifold pipe 20. The manifold pipe has an open gas supply end 22 and a closed end 24. The gas supply end 22 allows for heating fuel such as natural gas or propane to enter the manifold pipe from the gas supply line 1 of the building. Typically, the gas supply end is attached to the gas supply line by a gas valve 2 provided in the furnace 3.

The manifold pipe 20 also has a plurality of gas exit openings or orifices 26. The gas exit openings 26 are spaced apart and located on the manifold pipe 20 between the closed end 24 and the gas supply end 22. The gas exit openings are designed so that they may be inserted into the burner assembly 4 of a furnace 3 so that gas in the manifold pipe 20 can flow into the burner assembly to be ignited and provide heat to the heat exchange assembly 5 of the furnace 3.

The invention also includes a valve 30 on the manifold pipe 20. Preferably, the valve 30 is a ball type gas valve. The valve 30 is positioned on the manifold pipe 20 between two of the gas exit openings 26. The valve 30 allows a user to selectively increase or reduce gas flow to the gas exit openings 26 located between valve 30 and the closed end 24. Preferably, the valve 30 permits selective opening or closing of the gas flow to the gas exit openings 26 located between the valve 30 and the closed end 24. At the same time, the position of the valve 30 does not interfere with gas flowing out through the gas exit openings 26 located between the valve 30 and the supply end 22. These gas exit openings 26 allow gas to flow through them into the burner assembly 4 regardless of whether the valve 30 is open or closed.

Figure 3:
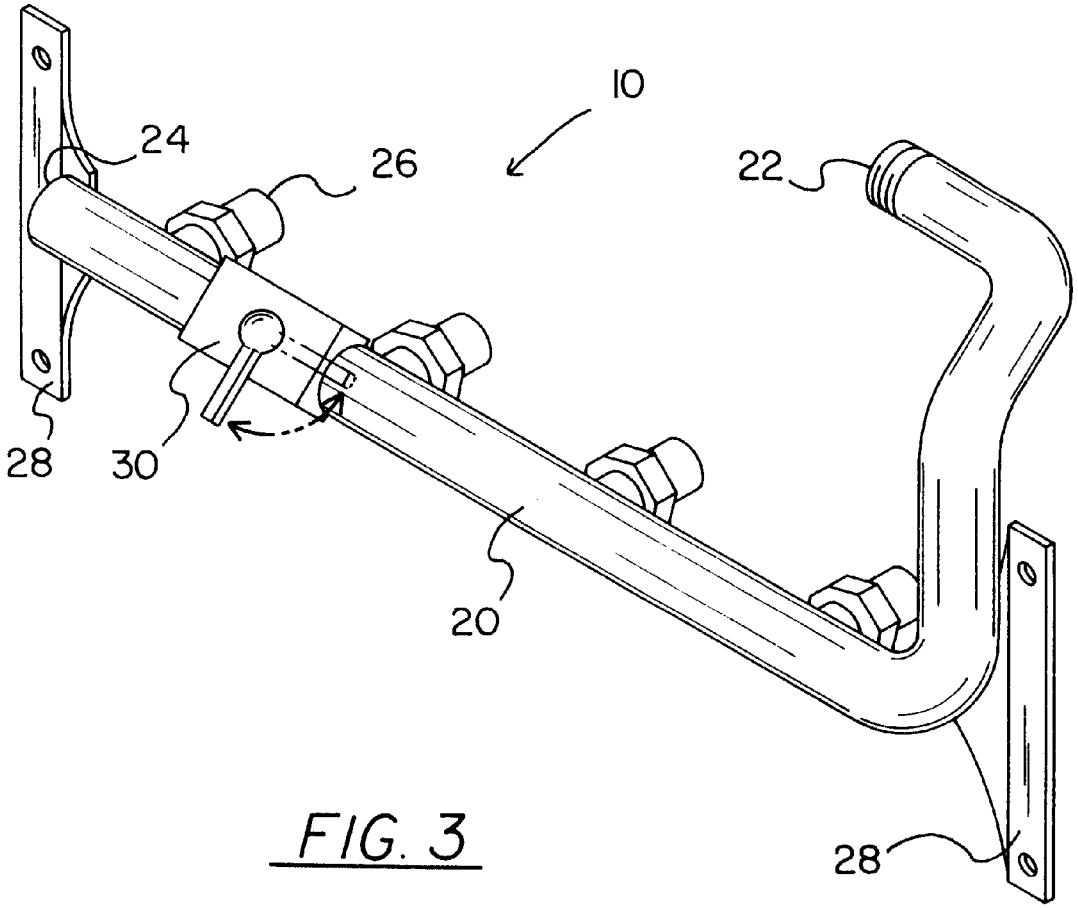
FIG. 3 is a perspective view of the variable burner orifice furnace manifold with four gas exit orifices.
Figure 2:
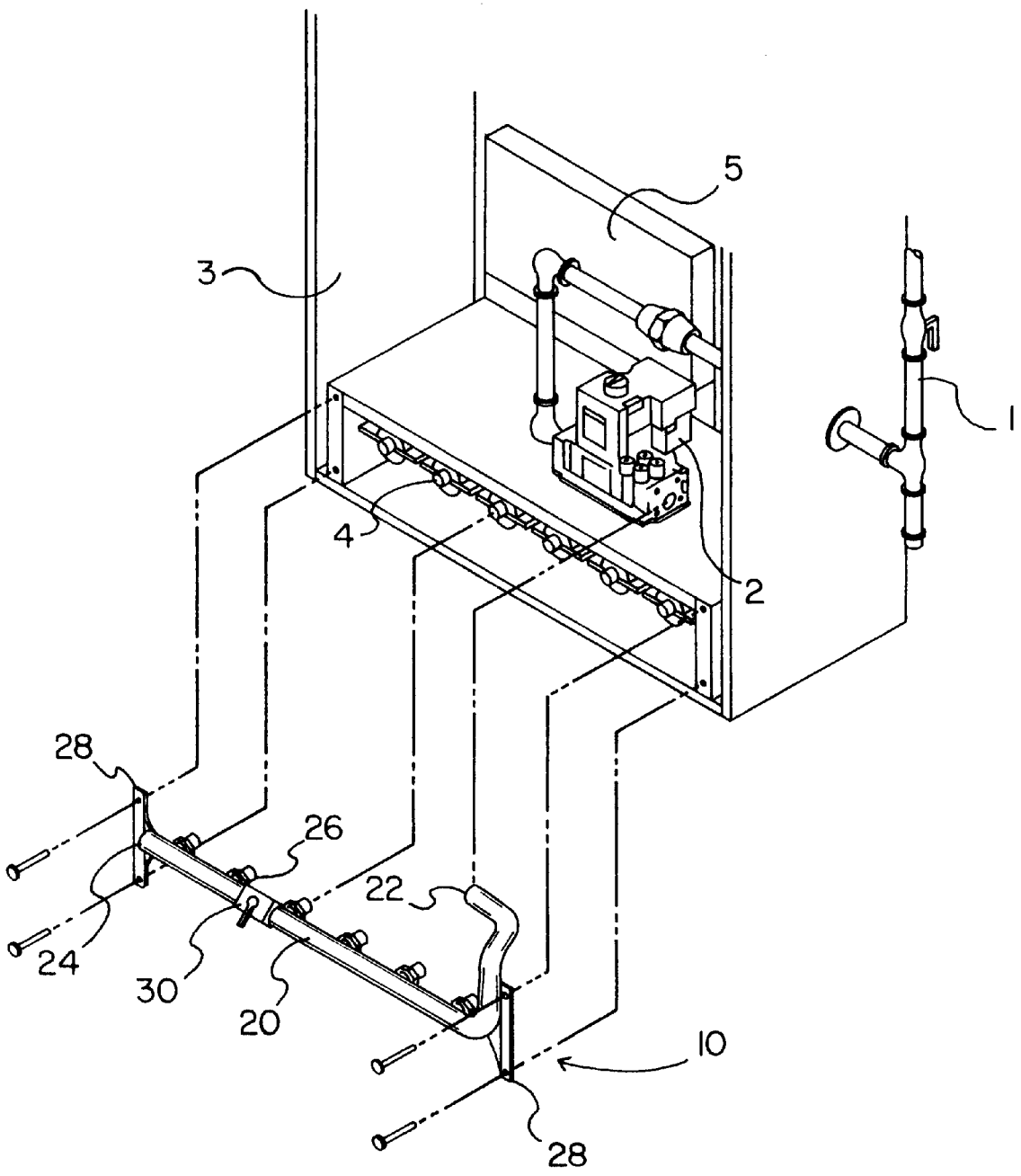
FIG. 2 is an exploded perspective view of the variable burner orifice furnace manifold with four gas exit orifices and its positioning on a combustion furnace.
Figure 4:
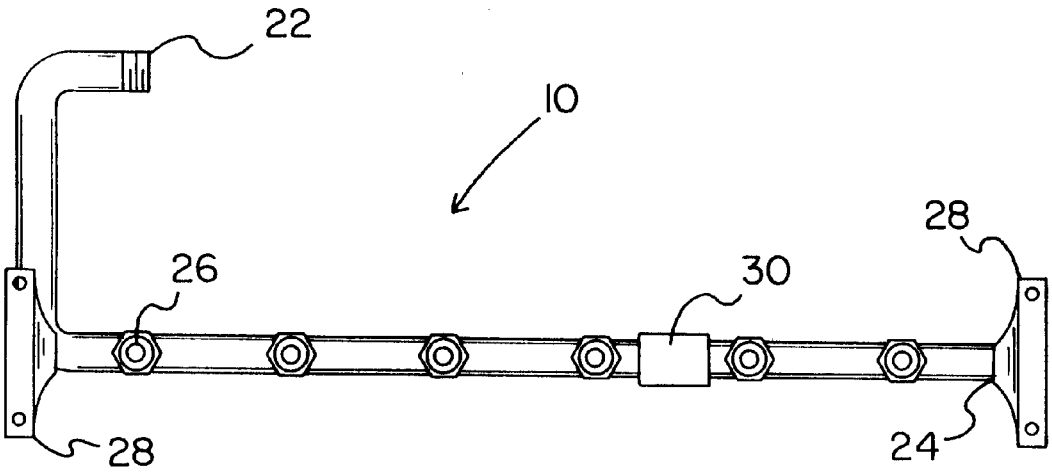
FIG. 4 is a side view of the six gas exit orifice version of the present invention.
Figure 5:
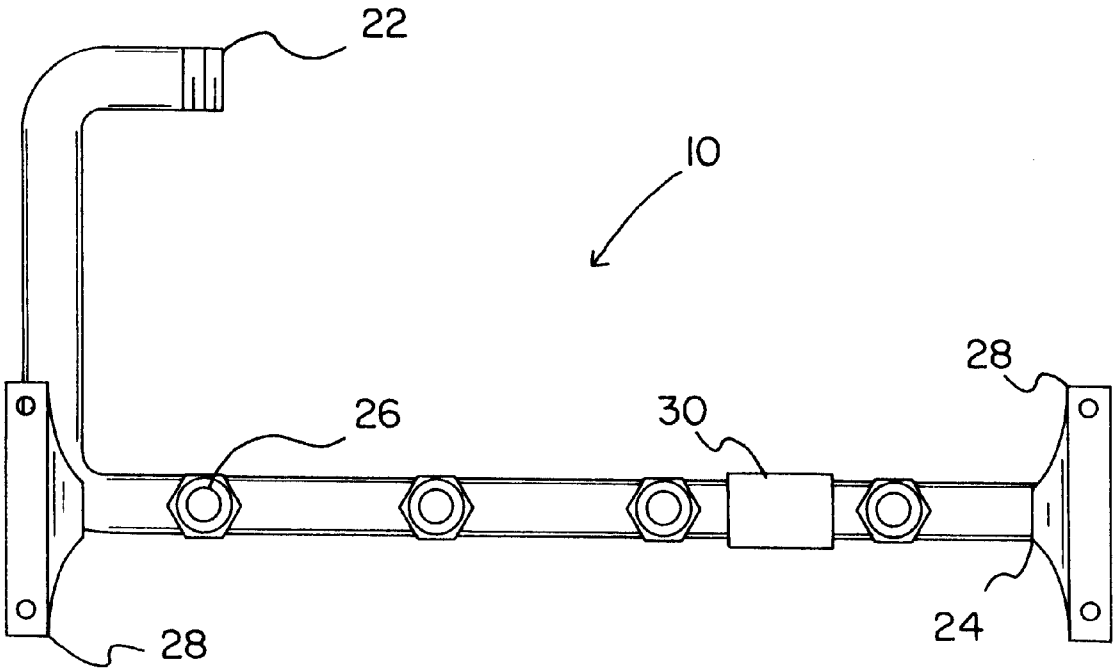
FIG. 5 is a side view of the four gas exit orifice version of the present invention.

Preferably, the valve 30 should be positioned on the manifold pipe 20 so that at most half of the total number of gas exit openings 26 are located between the valve 30 and the closed end 24. Ideally, the valve 30 should be positioned on the manifold pipe 20 so that between a third and a fourth of the gas exit valves 26 are positioned between the valve 30 and the closed end 24 of the manifold pipe 20. This allows the furnace 3 to provide enough heat when the valve 30 is closed to heat a building while significantly reducing the amount of natural gas or propane used. This ideal positioning of the valve 30 is depicted in FIGS. 1 and 3. FIG. 1 shows the valve 30 positioned on the manifold pipe 20 so that a third of the gas exit openings 26 can be closed by the valve 30. FIG. 3 shows the valve 30 positioned on the manifold pipe 20 so that a fourth of the gas exit openings 26 can be closed by the valve 30.

Optionally, extra valves 30 may be included on the manifold pipe 20. In such an optional embodiment, each extra valve 30 is positioned between different pairs of adjacent gas exit openings 26. For example, in a six gas exit opening manifold pipe, where the first gas exit opening is the gas exit opening closest to the open supply end 22 of the manifold pipe 20 and the sixth gas exit opening is the one closest to the closed end 24, a valve 30 may be placed between the sixth and fifth gas exit openings, a second valve 30 may be placed between the fifth gas exit and fourth gas exit openings and a third valve 30 may be placed between the fourth and third gas exit openings. This allows a user to variably select the number of closed gas exit openings 26 so that between one sixth and one half the total gas exit openings 26 are closed when the manifold pipe 20 is in use. This way, a user can add to the number of open gas exit openings 26 when the outside temperature becomes colder.

In use, the variable burner orifice furnace manifold 10 is attached at its mounting brackets 28 to the furnace 4 so that the gas exit openings 26 are inserted into the burner assembly 4. The open gas supply end 22 of the manifold pipe 20 is attached to the gas valve 2 of the furnace 3 to allow the heating fuel to enter the manifold pipe 20. The heating fuel exits the manifold pipe through the gas exit openings 26 into the burner assembly 4 where the fuel is ignited to provide heat to the heat exchange assembly 5.

When the user wishes to reduce fuel consumption by the furnace 3 when heating a building, the valve 30 is closed to prevent fuel from exiting the gas exit openings 26 between the closed end 24 and the valve 30. The heat exchange assembly 5 is then heated by the remaining open gas exit openings 26 between the valve 30 and the supply end 22 of the manifold pipe 20. In extreme cold temperatures, the user may open the valve 30 to have all the gas exit openings open to provide extra heat to the heat exchange assembly 5.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A furnace burner manifold system, for a furnace having a heat exchanger assembly and a burner assembly for providing heat to said heat exchanger assembly, said furnace burner manifold system comprising:

a manifold pipe having an open gas supply end, a closed end, said gas supply end being for providing gas into said manifold pipe, said manifold pipe having a mounting bracket located at the closed end of said pipe and a mounting bracket located at the gas supply end of said pipe;

a plurality of spaced apart gas exit openings being included on said manifold pipe between said gas supply end and said closed end, said gas exit openings being adapted for permitting gas to flow from said manifold pipe into a burner assembly; and a valve being provided on said manifold pipe and being positioned between said open gas supply end and said closed end, wherein the number of said gas exit openings being positioned between said valve and said open gas supply end is equal to or greater than the number of said gas exit openings being positioned between said valve and said manifold pipe closed end, said valve being to selectively open or close gas flow to said gas exit openings located between said valve and said manifold pipe closed end such that said valve controls gas flow to said gas exit openings between said valve and said manifold pipe closed end without affecting flow to said gas exit openings between said open gas supply end and said valve;

wherein said valve has an elongate manual operating lever for operating said valve, said operating lever having a first position corresponding to an open condition of said valve and a second position corresponding to a closed condition of said valve wherein in said first position said elongate operating lever is oriented in a direction substantially parallel to said manifold pipe to provide a visual indication of said open condition, and wherein in said second position said elongate operating lever is oriented in a direction substantially perpendicular to said manifold pipe to provide a visual indication of said closed conditions;

wherein said valve is positioned so that a fifth and a sixth of said gas exit openings are positioned between said valve and said manifold pipe closed end to permit selective reduction of the number of active burner assemblies to four.

* * * * *